US008006662B2

(12) United States Patent
Rörig

(10) Patent No.: US 8,006,662 B2
(45) Date of Patent: Aug. 30, 2011

(54) INNER LEVER FOR A SWITCHABLE FINGER LEVER OF A VALVE TRAIN OF AN INTERNAL COMBUSTION ENGINE

(75) Inventor: Bodo Rörig, Weisendorf (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 534 days.

(21) Appl. No.: 12/185,187

(22) Filed: Aug. 4, 2008

(65) Prior Publication Data

US 2009/0031975 A1 Feb. 5, 2009

(30) Foreign Application Priority Data

Aug. 3, 2007 (DE) ..... 10 2007 036 679

(51) Int. Cl.
*F01L 1/18* (2006.01)

(52) U.S. Cl. ..... 123/90.39; 123/90.44; 29/888.2; 74/559

(58) Field of Classification Search ..... 123/90.39, 123/90.44; 29/888.2; 74/559, 569
See application file for complete search history.

(56) References Cited

U.S. PATENT DOCUMENTS 5,544,626 A 8/1996 Diggs et al.

*Primary Examiner* — Ching Chang
(74) *Attorney, Agent, or Firm* — Volpe and Koenig, P.C.

(57) ABSTRACT

An inner lever (1) for a switchable finger lever (2) of a valve train of an internal combustion engine is provided, having a box-like main part (5) with two lateral walls (6), which are connected at a first end (7) by a transverse bar (8), which intrinsically includes a driver surface (9) for a coupling slide that can be guided longitudinally by the outer lever (3), and opposite from the first end (7), the lateral walls (6) have two strongly crimped together, thin-walled arms (10), which each extend in the direction toward the second end (11) of the inner lever (1) to form a longitudinal bar (12). The arms contact each other with their inner sides (15), and between the lateral walls (6), a cam contact surface (16) can be provided. The inner lever (1) made from thin-walled steel sheet metal at least to a large extent using punch-bending techniques.

9 Claims, 1 Drawing Sheet

INNER LEVER FOR A SWITCHABLE FINGER LEVER OF A VALVE TRAIN OF AN INTERNAL COMBUSTION ENGINE

CROSS-REFERENCE TO RELATED APPLICATIONS

This application claims the benefit of DE 10 2007 036 679.7, filed Aug. 3, 2007, which is incorporated herein by reference as if fully set forth.

BACKGROUND

The invention relates to an inner lever of a switchable finger lever of a valve train of an internal combustion engine, which can be arranged so that it can pivot relative to an outer lever in a longitudinal recess of the outer lever, which has a box-like main part with two opposing, upright lateral walls, which are connected at one end by a transverse bar, which intrinsically includes a driver surface for a coupling slide that can be advanced longitudinally by the outer lever, and away from this end the lateral walls have two arms, which extend in the direction toward the other end of the inner lever to form a longitudinal bar which has aligned openings for a shaft for the pivoting connection to the outer lever, and wherein a cam contact surface can be provided between the lateral walls.

Such an inner lever is known from FIG. 2 of U.S. Pat. No. 5,544,626. A disadvantage is its relatively complicated and also solid construction. It has also been determined that the openings for the shaft at the other end, as well as the openings for the roller pin, must be bored. All in all, such an inner lever is relatively expensive, which has a considerable disadvantageous effect on mass production.

SUMMARY

Therefore, the objective is to provide an inner lever of the class noted above, in which the cited disadvantages are overcome.

According to the invention, this objective is met by the inner lever being made from steel sheet metal at least to a large extent using punch-bending techniques and has upright, thin-walled lateral walls, which are connected to a firste end of the lever by an upright and also thin-walled transverse bar, wherein the lateral walls, in the direction toward the second end of the lever, have two, strongly crimped together, upright, and also thin-walled arms, which each taper into an upright and also thin-walled longitudinal bar, wherein these longitudinal bars contact each other with their inner sides.

Thus, an inner lever for a switchable cam follower (advantageously with a design allowing deactivation, but reversible designs are also conceivable and provided) is provided, in which the disadvantages noted above are overcome. Due to the preferred construction of the inner lever made from steel sheet metal, this can be produced, overall, very economically. The inner lever can be produced, for example, from a sheet metal strip on a punch-bending press, which comprises several draw-bending stages, wherein it is especially preferred to also punch the openings (shaft, roller pin), so that complicated boring, reaming, etc. according to the state of the art, is eliminated.

In one embodiment of the invention, the longitudinal bars of the inner lever are connected to each other on the other end, for example, by welding. Alternatively, adhesion, soldering, snap-on connections, or the like are possible. Optionally, a rivet or screw connection is also conceivable or allowing the longitudinal bars to simply lie on each other with their inner sides is conceivable.

It is also advantageous when the driving surface is applied on the transverse bar on its bottom side. Thus, expensive recesses in the transverse bar can be eliminated, which, however, are also conceivable and provided at this position (boreholes, windows, etc.).

The contours of the driver surface preferably have a complementary shape to an outer casing of the coupling element that can be driven by the outer lever. If the coupling element, for example, has a piston-like shape, then the driver surface can have a half-shell form.

The finger-like projection according to another embodiment of the invention can be applied, for example, in a simple flattening process during or before the actual bending/punching of the inner lever at one end of its "rough" contoured section and are used for contact with a lost-motion spring (for example, rotary leg spring), which extends in the region of the shaft. Alternatively, it is also conceivable to punch out the height-reduced, finger-like projection.

In addition, in a continuation of the invention it is proposed to let a projection for guidance in the longitudinal recess of the outer lever stick out from the outer surfaces of each lateral wall. These projections can be created in a non-cutting method through "embossing" (metal upset pressing or punching) or the like. The inner lever, oriented toward the inner surfaces of the arms of the outer lever, can be guided by the outsides of these projections, so that an exact allocation of the coupling element to its driver surface is always present in the transverse bar.

BRIEF DESCRIPTION OF THE DRAWINGS

The invention will be explained advantageously in more detail with reference to the drawing. Shown are.

DETAILED DESCRIPTION OF THE PREFERRED EMBODIMENTS

Figure 1:
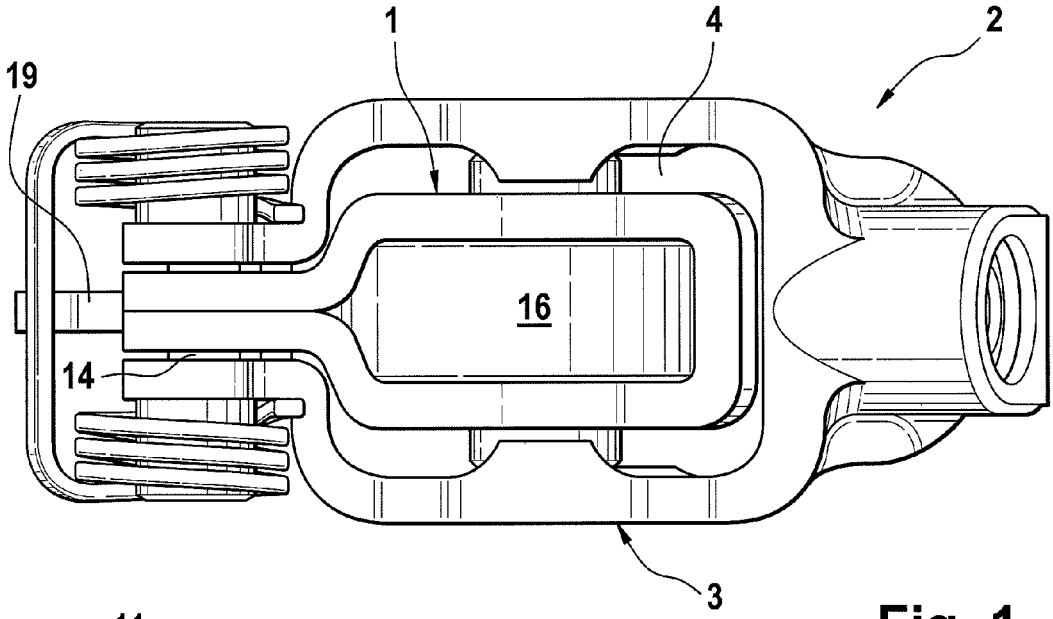
FIG. 1 is a top view of a cam follower with installed inner lever.

The figures disclose a box-like inner lever 1, which is produced from thin-walled steel sheet. The inner lever 1, which is formed as a "cutoff lever" according to FIG. 1, is provided for installation in a switchable finger lever 2 of a valve train of an internal combustion engine. An outer lever 3 of the finger lever 2 has a longitudinal recess 4, in which the inner lever 1 can be or is arranged. In the region of a second end 11, a shaft 14 penetrates the levers 1, 2, so that they can pivot relative to each other.

Figure 2:
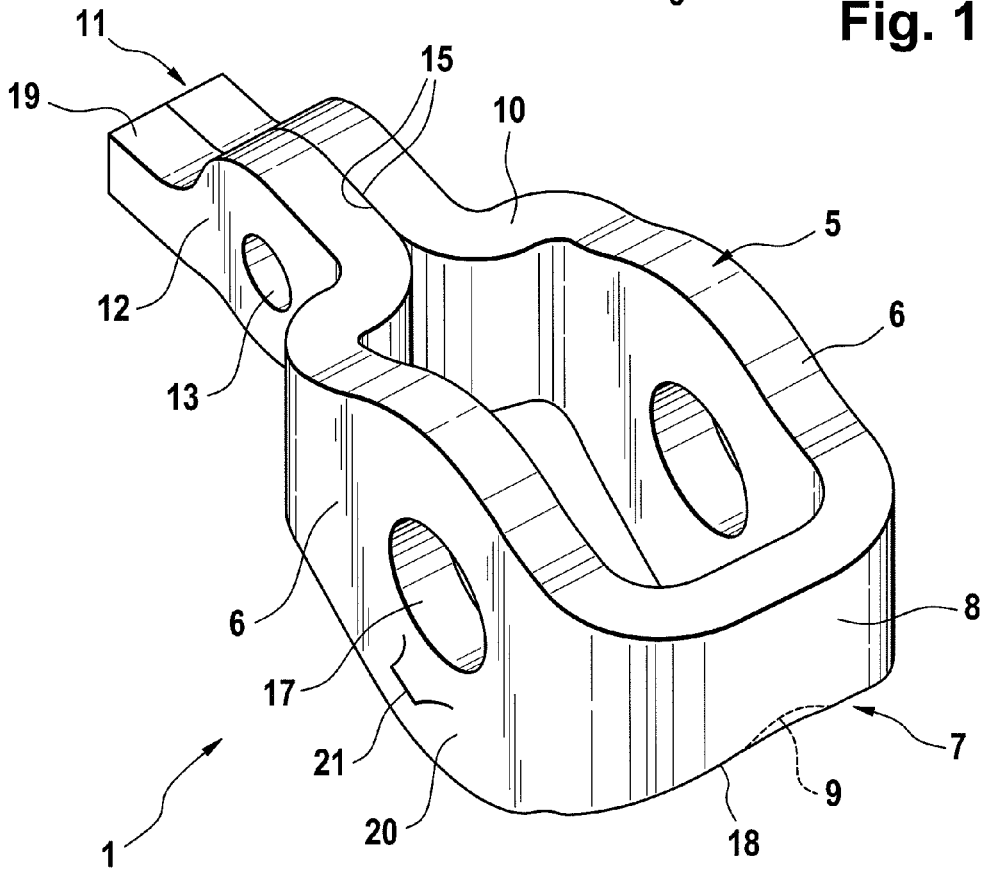
FIG. 2 is a perspective view of the inner lever according to the invention.

Referring to FIG. 2, the inner lever 1 is made from a box-like main part 5 with two opposing, thin-walled lateral walls 6. On the first end 7, the lateral walls 6 are connected to each other in one piece by a thin-walled transverse bar 8, which has, on its bottom side 18, a driver surface 9 indicated here for a coupling element (slide or the like) that can be driven longitudinally out of the outer lever 3 (from the direction of the first end 7) for the coupled state.

In the direction toward the second end 11, the lateral walls 6 transition into strongly crimped together thin-walled arms 10, which transition into thin-walled longitudinal bars 12 that contact one another with their inner sides 15 or that are, for example, welded. Directly on the end side, the longitudinal bars 12 taper into height-reduced projections 19, which, as can be taken from FIG. 1, are used for contact with a lost-motion spring and which are generated, for example, through flattening.

In addition, from FIG. 2 it can be seen that the lateral walls 5 each have a punched, circular cylindrical opening 17, which are used for holding a pin for supporting a roller as a cam contact surface 16.

As shown, the inner lever 1 (optionally also the outer lever 3) is made from thin-walled steel sheet. Here, it is generated in a punch-bending process, for example, from a sheet metal strip with a thickness of ca. 2.5 mm. A bending line for the sheet-metal blank after punching out its rough contours and flattening the projections 19, as well as punching the openings 13, 17 extends in the center in the region of the transverse bar 8, basically on a longitudinal center plane through the inner lever 1. Thus, it has a wing-like or eyeglass-like construction before the actual bending of the cut sheet-metal blank.

It is advantageous if, in the assembled state, the contours of the outer lever 3 follow the inner lever 1 at least to the greatest possible extent.

Optionally, it is conceivable and provided to construct the area of the longitudinal bar 12 on the other end 11 separately and to connect them through suitable connection measures, such as welding, to the box-like main part 5.

As also to be seen from FIG. 2, a projection 21 extends from each outer surface 20 of the corresponding lateral wall 6, preferably formed by a metal upset pressing or punching technique. This projection is used for oriented guidance of the inner lever 2 on the inner sides of the outer lever 3 in the installed state.

If the roller that can be seen from FIG. 1 is not provided as the cam contact surface 16, then a separate contact plate can also be applied, which then connects the top sides of the lateral walls 6 and which is also welded to these walls, for example.

LIST OF REFERENCE SYMBOLS

1) Inner lever
2) Finger lever
3) Outer lever
4) Longitudinal recess
5) Main part
6) Lateral wall
7) First end
8) Transverse bar
9) Driver surface
10) Arm
11) Second end
12) Longitudinal bar
13) Opening
14) Shaft
15) Inner side
16) Cam contact surface
17) Opening
18) Bottom side
19) Projection
20) Outer surface
21) Projection

The invention claimed is:

1. An inner lever for a switchable cam follower of a valve train of an internal combustion engine, which can be arranged so that it can pivot relative to an outer lever in a longitudinal recess of the outer lever, the inner lever comprising a main part with two opposing, upright, thin-walled lateral walls, which are connected at a first end by an upright, thin-walled transverse bar, which includes a driver surface thereon for a coupling slide that can be driven longitudinally by the outer lever, and opposite from the first end the opposing, upright, thin-walled lateral walls have two strongly crimped together, upright, thin-walled arms, which extend in a direction toward a second end of the inner lever, opposite the first end, and form upright, thin-walled longitudinal bars with aligned openings for a shaft for the pivoting connection to the outer lever, the upright, thin-walled longitudinal bars contact each other at inner sides thereof, a cam contact surface is located between the opposing, upright, thin-walled lateral walls, and the inner lever made from steel sheet metal is formed using punch-bending techniques.

2. The inner lever according to claim 1, wherein the aligned openings for the shaft are punched.

3. The inner Inner lever according to claim 1, wherein the opposing, upright, thin-walled lateral walls are provided with aligned, punched openings for arrangement of a pin for a roller that forms the cam contact surface.

4. The inner Inner lever according to claim 1, wherein the upright, thin-walled longitudinal bars are welded to each other with a spot or line shape.

5. The inner Inner lever according to claim 1, wherein the driver surface on the upright, thin-walled transverse bar is provided on a bottom side of the upright, thin-walled transverse bar.

6. The inner Inner lever according to claim 5, wherein the driver surface has a contour that is adapted to be complementary to the coupling slide formed by embossing.

7. The inner Inner lever according to claim 1, wherein, behind the aligned openings viewed in a direction toward the second end, the upright, thin-walled longitudinal bars taper into a finger projection reduced in height by flattening.

8. The inner Inner lever according to claim 1, wherein a projection extends from outer surfaces of each of the opposing, upright, thin-walled lateral walls into the longitudinal recess of the outer lever for guidance.

9. The inner Inner lever according to claim 8, wherein the projection that extends from each of the outer surfaces of each of the opposing, upright, thin-walled lateral walls are formed via upset or displaced metal pressed from the opposing, upright, thin-walled lateral walls.

* * * * *

UNITED STATES PATENT AND TRADEMARK OFFICE

CERTIFICATE OF CORRECTION

PATENT NO. : 8,006,662 B2
APPLICATION NO. : 12/185187
DATED : August 30, 2011
INVENTOR(S) : Bodo Rörig It is certified that error appears in the above-identified patent and that said Letters Patent is hereby corrected as shown below:

IN THE CLAIMS

In claim 3, at column 4, line 27, after the word "inner", delete "Inner".

In claim 4, at column 4, line 31, after the word "inner", delete "Inner".

In claim 5, at column 4, line 34, after the word "inner", delete "Inner".

In claim 6, at column 4, line 38, after the word "inner", delete "Inner".

In claim 7, at column 4, line 41, after the word "inner", delete "Inner".

In claim 8, at column 4, line 45, after the word "inner", delete "Inner".

In claim 9, at column 4, line 49, after the word "inner", delete "Inner".

Signed and Sealed this
Seventh Day of February, 2012

David J. Kappos

David J. Kappos
*Director of the United States Patent and Trademark Office*